US009879934B2

(12) United States Patent
Thomas et al.

(10) Patent No.: US 9,879,934 B2
(45) Date of Patent: Jan. 30, 2018

(54) SUPPRESSED PISTOL

(71) Applicant: SilencerCo, LLC, West Valley City, UT (US)

(72) Inventors: Phillip Brady Thomas, Cocoa, FL (US); Casey Brandol, West Jordan, UT (US); Jonathon Shults, Sandy, UT (US); Harrison Holden, Sandy, UT (US)

(73) Assignee: SilencerCo, LLC, West Valley City, UT (US)

( * ) Notice: Subject to any disclaimer, the term of this patent is extended or adjusted under 35 U.S.C. 154(b) by 0 days.

(21) Appl. No.: 15/261,079

(22) Filed: Sep. 9, 2016

(65) Prior Publication Data

US 2017/0205173 A1 Jul. 20, 2017

Related U.S. Application Data

(60) Provisional application No. 62/217,106, filed on Sep. 11, 2015.

(51) Int. Cl.
*F41A 21/00* (2006.01)
*F41A 21/30* (2006.01)
(Continued)

(52) U.S. Cl.
CPC ..... *F41A 21/30* (2013.01); *F41A 3/54* (2013.01); *F41A 3/66* (2013.01); *F41A 3/82* (2013.01); *F41A 5/02* (2013.01); *F41C 3/00* (2013.01)

(58) Field of Classification Search
CPC ..... F41C 3/00; F41A 3/12; F41A 3/00; F41A 3/64
(Continued)

(56) References Cited

U.S. PATENT DOCUMENTS 825,010 A 7/1906 Snow
918,784 A 4/1909 Snow
(Continued)

FOREIGN PATENT DOCUMENTS

EP 2977708 A1 1/2016
WO 9407103 A1 3/1994

OTHER PUBLICATIONS

Copenheaver, Blaine; International Search Report from counterpart International Patent Application No. PCT/US2016/050712, dated Dec. 30, 2016, pp. 1-5, United States Patent and Trademark Office as International Searching Authority, Alexandria, Virginia USA.
(Continued)

*Primary Examiner* — J. Woodrow Eldred

(57) ABSTRACT

A suppressed pistol has a breech block and a slide mounted on a frame. The breech block and slide are separate pieces, movable relatively to one another and the frame. A link extends between the breech block and the frame. The link carries a cam and a cam follower. The cam follower on the link engages a cam on the frame, the cam on the link engages a cam follower on the slide. Action between the cams, cam followers and the link causes separation between the breech block and the slide during operation of the pistol. The suppressor includes a container having baffle plates with truncated cones defining openings offset from the geometric centers of the baffle plates.

39 Claims, 10 Drawing Sheets

(51) Int. Cl.

| | |
|---|---|
| ***F41A 3/54*** | (2006.01) |
| ***F41A 3/66*** | (2006.01) |
| ***F41A 3/82*** | (2006.01) |
| ***F41A 5/02*** | (2006.01) |
| ***F41C 3/00*** | (2006.01) |

(58) Field of Classification Search
USPC ..... 42/2, 14
See application file for complete search history.

(56) References Cited

U.S. PATENT DOCUMENTS

| | | | | |
|---|---|---|---|---|
| 959,400 | A | 5/1910 | Stinson | |
| 1,006,595 | A | 10/1911 | Red | |
| 1,017,003 | A | 2/1912 | Kenney | |
| 1,111,202 | A | 9/1914 | Westfall | |
| 1,341,363 | A | 5/1920 | Fiala | |
| 1,348,733 | A | 8/1920 | Pedersen | |
| 1,394,490 | A | 10/1921 | Giles | |
| 1,482,805 | A | 2/1924 | Maxim | |
| 1,605,864 | A | 11/1926 | Steinegger | |
| 1,747,876 | A | 2/1930 | Metzgar | |
| 1,874,326 | A | 8/1932 | Mason | |
| 2,451,514 | A | 10/1948 | Sieg | |
| 2,780,962 | A | 2/1957 | Ressler et al. | |
| 2,852,983 | A | 9/1958 | Netzer | |
| 2,870,679 | A | 1/1959 | Collins | |
| 2,900,875 | A | 8/1959 | Fergus et al. | |
| 3,306,168 | A | 2/1967 | Blumrick | |
| 3,857,325 | A | 12/1974 | Thomas | |
| 4,291,610 | A | 9/1981 | Waiser | |
| 4,576,083 | A | 3/1986 | Seberger, Jr. | |
| 4,584,924 | A | 4/1986 | Taguchi | |
| 4,588,043 | A | 5/1986 | Finn | |
| 4,757,741 | A | 7/1988 | Brothers | |
| 4,893,544 | A | 1/1990 | Hawley et al. | |
| 4,907,488 | A | 3/1990 | Seberger | |
| 5,110,145 | A | 5/1992 | Stewart | |
| 5,164,535 | A | 11/1992 | Leasure | |
| 5,192,219 | A | 3/1993 | Fowler et al. | |
| 5,215,336 | A | 6/1993 | Worthing | |
| 5,259,690 | A | 11/1993 | Legge | |
| 5,425,299 | A | 6/1995 | Teetzel | |
| 5,581,046 | A * | 12/1996 | Weldle | F41A 3/86 89/163 |
| 5,596,161 | A | 1/1997 | Sommers | |
| 5,679,916 | A | 10/1997 | Weichert | |
| 5,882,044 | A | 3/1999 | Sloane | |
| D415,813 | S | 10/1999 | O'Quinn et al. | |
| 6,079,311 | A | 6/2000 | O'Quinn et al. | |
| D435,623 | S | 12/2000 | Andrews, Jr. et al. | |
| 6,302,009 | B1 | 10/2001 | O'Quinn et al. | |
| 6,575,074 | B1 | 6/2003 | Gaddini | |
| 6,837,139 | B2 | 1/2005 | Meyers | |
| 6,948,415 | B2 | 9/2005 | Matthers et al. | |
| 7,156,424 | B2 | 1/2007 | McCord | |
| 7,237,467 | B1 | 7/2007 | Melton | |
| 7,302,774 | B2 | 12/2007 | Meyers | |
| 7,325,474 | B2 | 2/2008 | Yoshimura et al. | |
| 7,398,614 | B2 * | 7/2008 | Rozhkov | F41A 3/56 42/2 |
| 7,587,969 | B2 | 9/2009 | Silvers | |
| 7,588,122 | B2 | 9/2009 | Brittingham | |
| 7,594,464 | B2 | 9/2009 | Dueck | |
| 7,661,349 | B1 | 2/2010 | Brittingham | |
| 7,743,693 | B1 | 6/2010 | Brittingham | |
| 7,856,914 | B2 | 12/2010 | Shults et al. | |
| 7,874,238 | B2 | 1/2011 | Silvers | |
| 7,891,282 | B1 | 2/2011 | DeGroat | |
| 7,905,170 | B1 | 3/2011 | Brittingham et al. | |
| 7,905,319 | B2 | 3/2011 | Sullivan | |
| 7,931,118 | B1 | 4/2011 | Cronhelm | |
| 7,987,944 | B1 | 8/2011 | Brittingham et al. | |
| 8,091,462 | B2 | 1/2012 | Dueck et al. | |
| 8,100,224 | B1 | 1/2012 | Olson | |
| 8,162,100 | B2 | 4/2012 | Shults et al. | |
| 8,322,266 | B2 | 12/2012 | Presz, Jr. et al. | |
| 8,424,441 | B2 | 4/2013 | Brittingham et al. | |
| 8,439,155 | B2 | 5/2013 | Shults et al. | |
| 8,453,789 | B1 | 6/2013 | Honigmann et al. | |
| 8,490,535 | B1 | 7/2013 | Moore et al. | |
| 8,505,680 | B2 | 8/2013 | Dueck | |
| 8,516,941 | B1 | 8/2013 | Oliver | |
| 8,528,691 | B1 | 9/2013 | Carmichael et al. | |
| 8,555,765 | B2 | 10/2013 | Graham, II et al. | |
| 8,714,301 | B2 | 5/2014 | Shults | |
| 8,794,376 | B2 | 8/2014 | Shults et al. | |
| 8,857,306 | B1 | 10/2014 | Edsall | |
| 8,950,546 | B2 | 2/2015 | Shults et al. | |
| 8,991,550 | B2 | 3/2015 | Coley | |
| 9,097,482 | B1 | 8/2015 | Holden et al. | |
| 9,121,656 | B1 | 9/2015 | McKenzie | |
| D742,987 | S | 11/2015 | Holden et al. | |
| D742,988 | S | 11/2015 | Holden et al. | |
| D742,989 | S | 11/2015 | Holden et al. | |
| 9,328,984 | B2 | 5/2016 | Shults et al. | |
| 9,470,465 | B2 * | 10/2016 | Curry | F41A 21/00 |
| 2005/0126382 | A1 | 6/2005 | Yoshimura et al. | |
| 2006/0060076 | A1 | 3/2006 | Dueck et al. | |
| 2007/0095198 | A1 | 5/2007 | Dater et al. | |
| 2007/0107590 | A1 | 5/2007 | Silvers | |
| 2007/0266844 | A1 | 11/2007 | Dueck | |
| 2008/0148928 | A1 | 6/2008 | McClellan | |
| 2008/0271944 | A1 | 11/2008 | Brittingham | |
| 2009/0050403 | A1 | 2/2009 | Brittingham | |
| 2009/0178549 | A1 | 7/2009 | Meyers | |
| 2010/0126334 | A1 | 5/2010 | Shults et al. | |
| 2010/0139145 | A1 | 6/2010 | Brittingham | |
| 2010/0199834 | A1 | 8/2010 | Dueck et al. | |
| 2010/0313743 | A1 | 12/2010 | Dueck et al. | |
| 2011/0017058 | A1 | 1/2011 | Kaminsky | |
| 2011/0036233 | A1 | 2/2011 | DeGroat | |
| 2011/0061966 | A1 | 3/2011 | Brittingham | |
| 2011/0067950 | A1 | 3/2011 | Shults et al. | |
| 2011/0072958 | A1 | 3/2011 | Brittingham et al. | |
| 2011/0297477 | A1 | 12/2011 | Koumbis | |
| 2012/0152093 | A1 | 6/2012 | Koumbis | |
| 2012/0180624 | A1 | 7/2012 | Troy et al. | |
| 2014/0020977 | A1 | 1/2014 | Shults | |
| 2015/0226506 | A1 | 8/2015 | Shults et al. | |
| 2015/0253099 | A1 | 9/2015 | Shults | |
| 2017/0184358 | A1 * | 6/2017 | Zajk | F41A 5/06 |

OTHER PUBLICATIONS

Copenheaver, Blaine; Written Opinion from counterpart International Patent Application No. PCT/US2016/050712, dated Dec. 30, 2016, pp. 1-5, United States Patent and Trademark Office as International Searching Authority, Alexandria, Virginia USA.

* cited by examiner

FIG. 1
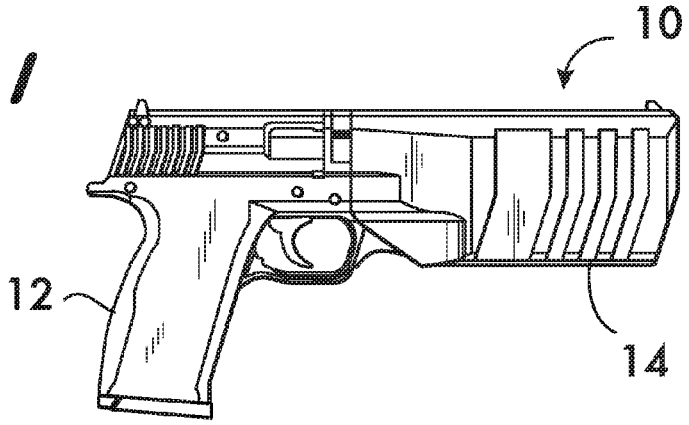
FIG. 2A
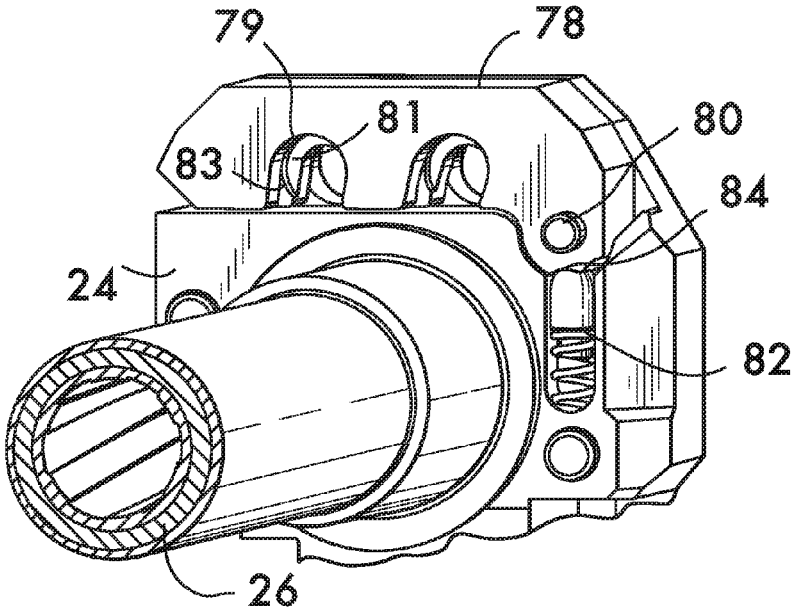
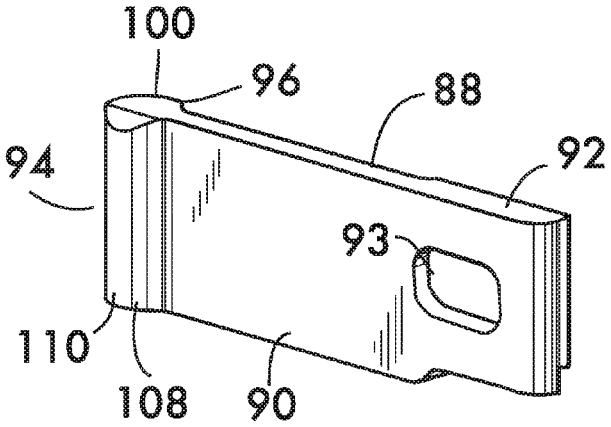
FIG. 2B

SUPPRESSED PISTOL

CROSS REFERENCE TO RELATED APPLICATION

This application is based upon and claims priority to U.S. Provisional Application No. 62/217,106 filed Sep. 11, 2015 which application is hereby incorporated by reference.

FIELD OF THE INVENTION

This invention relates to firearms, and in particular to pistols having sound suppressors.

BACKGROUND

Sound suppressors for firearms, particularly pistols, are well known and are coming into widespread use for shooting sports such as "plinking", competitive target shooting, and target practice as shooters begin to realize the advantages to comfort and hearing protection afforded by suppressed firearms.

Suppressors according to the prior art, when mounted on pistols, extend the length of the pistol and thereby alter its handling and balance characteristics. The extended length of prior art suppressors also makes it difficult to holster a suppressed pistol, for example, when carried by elite military units. There are clear advantages to be realized by a pistol having a more compact yet effective suppressor.

SUMMARY

One aspect of the invention concerns a firearm. In an example embodiment, the firearm comprises a frame having a first cam mounted thereon. A barrel is fixedly attached to the frame. The barrel has a muzzle and a breech and defines a firing axis therebetween. A breech block is movably mounted on the frame and having a breech face in facing relation with the breech. A link extends between the breech block and the frame. A first cam follower is mounted on the link. The first cam follower engages the first cam. A second cam is mounted on the link. A slide is mounted on the frame and is movable relatively to both the frame and the breech block. At least a first spring operating between the slide and the frame biases the slide toward the breech. The slide is engageable with the breech block for biasing the breech block toward the breech. A second cam follower is mounted on the slide and engaged by the second cam. Upon motion of the breech block away from the breech, engagement between the first cam follower and the first cam moves the second cam into engagement with the second cam follower thereby moving the breech block relatively to the slide.

In one example embodiment, the first cam comprises a first surface oriented angularly with respect to the firing axis. In a particular example embodiment, the first surface has an orientation angle from 20° to 70°. In specific example embodiment, the first surface has an orientation angle of 45°.

In an example embodiment, the link comprises a plate and the first cam follower comprises a cylindrical surface mounted on the plate. By way of example, the plate is captured between the breech block and the slide. In a further example, the plate is pivotably attached to the breech block.

In another example, the second cam follower comprises a second surface oriented angularly with respect to the firing axis. In a particular example, the second surface has an orientation angle from 5° to 60°. In a specific example, the second surface has an orientation angle of 30°.

By way of example, the link comprises a plate and the second cam comprises a cylindrical surface mounted on the plate. In another example the plate is captured between the breech block and the slide. Further by way of example, the plate is pivotably attached to the breech block. In an example embodiment, a striker mounted within the breech block.

An example firearm further comprises a cavity positioned within the slide. The cavity has a front wall positioned proximate to the breech. A headpiece surrounds the breech. A first guide rod has a first end fixed to the headpiece and a second end has a stop surface projecting therefrom. The second end extends into the cavity. The first spring is positioned within the cavity surrounding the first guide rod and engages the front wall and the stop surface for biasing the slide toward the breech.

In another example embodiment the firearm comprises a second guide rod having a first end fixed to the headpiece and a second end having a stop surface projecting therefrom. The second end extends into the cavity. A second spring is positioned within the cavity surrounding the second guide rod and engaging the front wall and the stop surface on the second guide rod for biasing the slide toward the breech. In an example the cavity is positioned overlying the breech block.

Further by way of example a firearm according to the invention comprises a clip movably mounted on the head piece. The clip is movable between an open position and a closed position. A first cutout is positioned in the clip for receiving the first guide rod when the clip is in the closed position. The first cutout comprises an axially facing surface engageable with an enlarged head at an end of the first guide rod for securing the first guide rod to the head piece when the clip is in the closed position. In an example embodiment the first cutout further comprises a radially facing surface positioned adjacent to the axially facing surface. The radially facing surface engages the enlarged head and prevents movement of the clip from the closed to the open position. In a specific example embodiment the clip is pivotably mounted to the head piece. Further by way of example the clip comprises a second cutout positioned adjacent to the first cutout. In an example embodiment the second cutout comprises an axially facing surface engageable with an enlarged head at an end of a second guide rod for securing the second guide rod to the head piece when the clip is in the closed position. Further by way of example, a radially facing surface is positioned adjacent to the axially facing surface of the second cutout. The radially facing surface of the second cutout engages the enlarged head of the second guide rod and prevents movement of the clip from the closed to the open position.

In an example embodiment the firearm further comprises first and second rails positioned on opposite sides of the frame and oriented parallel to the firing axis. At least a first stop surface projects from the first rail. First and second tabs are positioned on opposite sides of the slide. The first and second tabs respectively engage the first and second rails for retaining the slide to the frame. First and second lugs are positioned on opposite sides of the slide in spaced relation to the first and second tabs respectively. The first lug is engageable with the first stop surface for limiting motion of the slide in a direction away from the breech. In a further example firearm each of the rails has a gap therein for receiving a respective one of the first and second lugs to permit assembly and disassembly of the slide onto the frame.

An example firearm encompassed by the invention further comprises a sound suppressor mounted on the barrel. In a specific example the sound suppressor comprises a container having an entrance orifice and an exit orifice aligned with the firing axis. The container defines a plurality of baffle chambers. By way of example the container comprises at least three the baffle chambers. In a further example the container defines an expansion chamber adjacent to the entrance orifice. The barrel extends into the expansion chamber in an example embodiment. By way of example the container is attached to the barrel between the muzzle and the breech.

In an example, at least one of the baffle chambers includes a baffle comprising a plate oriented transversely to the firing axis. A truncated cone projects from the plate. The truncated cone defines an opening through the plate. In an example embodiment, the plate has a geometric center and the opening is positioned offset from the geometric center and aligned with the firing axis.

In a specific example embodiment the plate comprises at least first and second webs positioned within the container. The first and second webs are aligned with one another and oriented transversely to the firing axis. The first web has a first edge and the second web has a second edge in facing relation with the first web. The truncated cone is positioned between the first and second edges of the webs. In yet another example the truncated cone is surrounded by a frame having first and second edges oppositely disposed. A first channel is positioned in the first edge and extends lengthwise there along. A second channel is positioned in the second edge and extends lengthwise there along. The first channel receives the first edge of the first web, the second channel receives the second edge of the second web for mounting the truncated cone within the container. In a specific example the first web is longer than the second web.

The invention further includes a sound suppressor for a firearm. In one example embodiment the sound suppressor comprises a container having an entrance orifice and an exit orifice aligned with one another to define a firing axis. The container defines a plurality of baffle chambers. At least one of the baffle chambers includes a baffle comprising a plate oriented transversely to the firing axis. The plate has a geometric center. A truncated cone projects from the plate. The truncated cone defines an opening through the plate. The opening is positioned offset from the geometric center and aligned with the firing axis.

In a specific embodiment the container comprises first and second sidewalls oppositely disposed. The plate is oriented transversely to the sidewalls and extends therebetween. Another example embodiment further comprises an expansion chamber positioned adjacent to the entrance orifice. By way of example, means are positioned within the entrance orifice for attaching the container to a barrel of the firearm. In a particular example, the means for attaching comprises internal threads in the container surrounding the entrance orifice. In a specific example embodiment the container comprises three the baffles. By way of further example, the plate comprises at least first and second webs positioned within the container. The first and second webs are aligned with one another and oriented transversely to the firing axis. The first web has a first edge and the second web has a second edge in facing relation with the first web. The truncated cone is positioned between the first and second edges of the webs.

In an example sound suppressor the truncated cone is surrounded by a frame having first and second legs oppositely disposed. A first channel is positioned in the first leg and extends lengthwise there along. A second channel is positioned in the second leg and extends lengthwise there along. The first channel receives the first edge of the first web, the second channel receives the second edge of the second web for mounting the truncated cone within the container. In a particular example embodiment the first web is longer than the second web.

In an example embodiment the container comprises first and second sidewalls oppositely disposed. The first and second webs are oriented transversely to the sidewalls and extending therebetween.

The invention further encompasses an example sound suppressor for a firearm comprising a container having an entrance orifice and an exit orifice aligned with the entrance orifice and defining a firing axis. A plurality of first webs are positioned within the container and oriented transversely to the firing axis. Each of the first webs has a first edge facing the firing axis. A plurality of second webs are positioned within the container and oriented transversely to the firing axis. Each of the second webs has a second edge facing a respective one of the first edges. A plurality of truncated cones are positioned within the container. Each of the cones is positioned between a respective first and second edge of one of the first and second webs. Each of the cones defines an opening aligned with the firing axis.

In a specific example embodiment, each of the cones comprises a frame oriented transversely to the firing axis. Each of the frames comprises first and second legs oppositely disposed. A first channel is positioned in each of the first legs and extends lengthwise there along. A second channel is positioned in each of the second legs and extends lengthwise there along. For each of the frames, the first channel receives the first edge of one of the first webs, the second channel receives the second edge of one of the second webs for mounting the plurality of cones within the container.

In a specific example embodiment, each of the cones projects toward the entrance orifice. In another example embodiment, each one of the first webs is longer than each one of the second webs. In a particular example embodiment the container comprises first and second sidewalls oppositely disposed. The first and second webs are oriented transversely to the sidewalls and extend therebetween. By way of a specific example, each of the truncated cones is a right circular truncated cone. Further by way of example, each of the truncated cones comprises an inner surface surrounding the firing axis. A lip is positioned on the inner surface of each of the truncated cones. Each of the lips extends around and projects toward the firing axis. By way of example, each of the lips is positioned at an end of each of the truncated cones distal to the frames on which the truncated cones are respectively mounted. In a further example, each of the truncated cones comprises a sidewall. An aperture is positioned in each of the sidewalls. Also by way of example, each of the apertures is contiguous with one of the openings in each of the truncated cones. In a particular example embodiment, the sound suppressor comprises three of the cones. Also by way of example, the sound suppressor further comprises four of the webs.

In an example embodiment, the sound suppressor comprises an expansion chamber positioned adjacent to the entrance orifice. In an example suppressor, means are positioned within the entrance orifice for attaching the container to a barrel of the firearm. In a particular example embodiment, the means for attaching comprises internal threads in the container surrounding the entrance orifice.

Another example embodiment of a sound suppressor for a firearm comprises a container having an entrance orifice and an exit orifice aligned with one another to define a firing axis. The container comprises a plurality of baffle chambers.

The baffle chambers are defined by a plurality of segments attached to one another end to end. Each one of the segments comprises a plate oriented transversely to the firing axis, a skirt surrounding the plate and extending transversely thereto and a truncated cone projecting from the plate. The truncated cone defines an opening through the plate.

A further example suppressor embodiment comprises an expansion chamber attached to one of the segments. In an example embodiment the expansion chamber comprises a first bulkhead oriented transversely to the firing axis. A second bulkhead is in spaced relation to the first bulkhead and oriented transversely to the firing axis. A sidewall surrounds the first and second bulkheads and extends between them. In a specific example the first bulkhead intersects the firing axis and the second bulk head is offset from the firing axis. The first bulkhead has a hole therethrough. In a particular example the expansion chamber defines the entrance orifice.

By way of example a suppressor further comprises at least one fastener extending between and fixing the segments end to end. An example embodiment also comprises means positioned within the expansion chamber for attaching the container to a barrel of the firearm. In a specific example embodiment the means for attaching comprises a threaded nut adapted to receive compatible screw threads surrounding at least a portion of the barrel.

BRIEF DESCRIPTION OF THE DRAWINGS

FIG. 1 is a side view of an example suppressed pistol according to the invention;

FIGS. 2A and 2B are isometric views of components shown in FIG. 2 on an enlarged scale;

DETAILED DESCRIPTION

Figure 2:
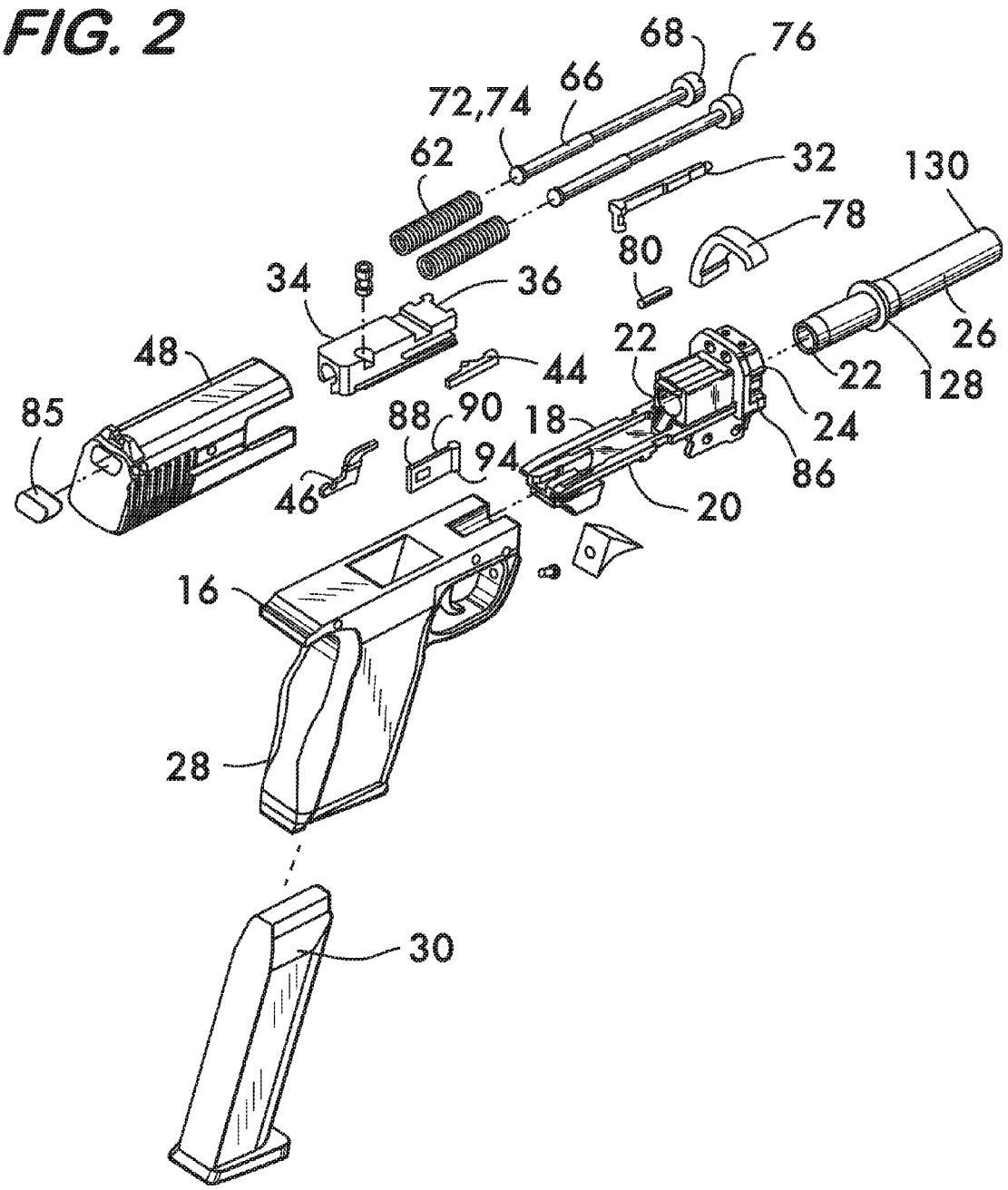
FIG. 2 is an exploded isometric view of the pistol shown in FIG. 1.
Figure 3:
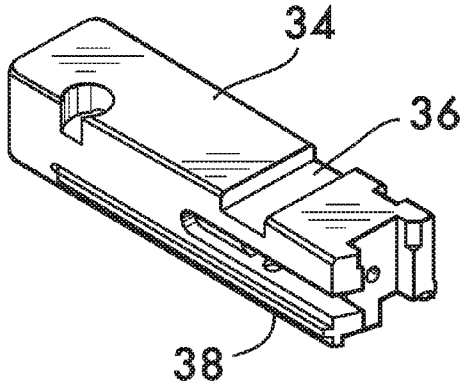
FIG. 3 is an isometric view of an example breech block shown in FIG. 2.
Figure 4:
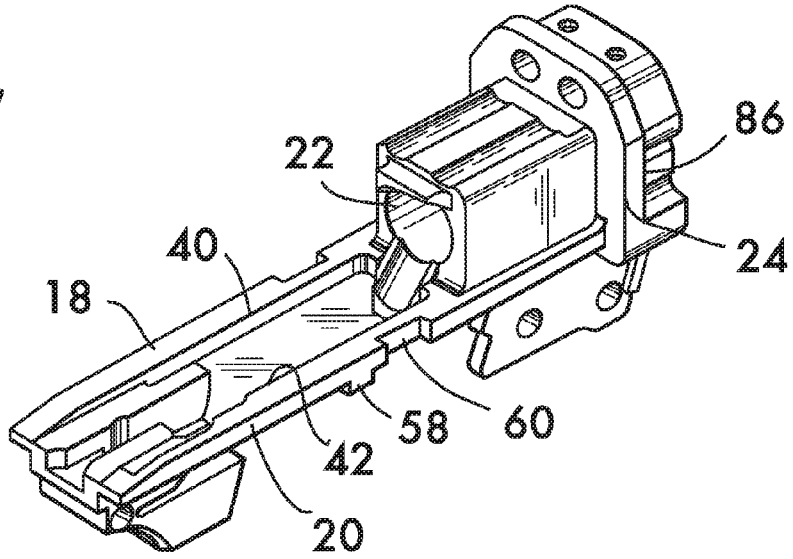
FIG. 4 is an isometric view of an example head piece shown in FIG. 2.

FIG. 1 shows an example embodiment of a suppressed pistol 10 according to the invention. Suppressed pistol 10 comprises a pistol 12 and its associated suppressor 14. As shown in the exploded view of FIG. 2, pistol 12 comprises a frame 16. Frame 16 includes slide rails 18 and 20, a breech 22 and a head piece 24 surrounding the breech 22. A barrel 26 is fixedly mounted to the frame via engagement with the head piece 24. A grip 28 is part of the frame 16, the grip receiving a magazine 30 for feeding ammunition to the pistol. Mounted within the frame are the trigger mechanism (not shown) which, in this example embodiment, actuates a striker 32. Striker 32 is positioned within a breech block 34 which rides along the rails 18 and 20 between a position "in battery" where the face 36 of the breech block is positioned against the breech 22, and a position "out of battery" where the breech face 36 is in spaced relation away from the breech. As shown in detail in FIGS. 3 and 4, the breech block 34 has runners 38 that extend lengthwise along and engage the inwardly facing edges 40 and 42 of rails 18 and 20. As shown in FIG. 2 an extractor 44 is pivotably mounted on the breech block 34. The extractor 44 cooperates with an ejector 46 mounted on the frame to extract and eject a spent cartridge during cycling of the pistol 12.

Figure 5:
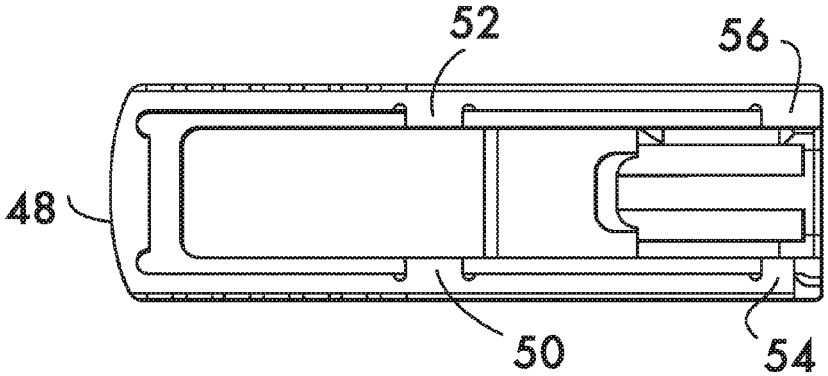
FIG. 5 is a bottom view of the slide shown in FIG. 2.

A slide 48 is also mounted on rails 18 and 20, is separate from the breech block 34, and therefore movable relatively to it and the frame 16 along the rails. As shown with reference to FIGS. 4 and 5, the slide 48 has first and second tabs 50 and 52 positioned on opposite sides of the slide. The tabs 50 and 52 project inwardly toward one another to engage the rails 18 and 20 for retaining the slide to the rails during sliding motion. Also shown in FIG. 5, first and second lugs 54 and 56 are positioned on opposite sides of the slide 48. The lugs 54 and 56 also project inwardly toward one another to engage the rails 18 and 20 to retain the slide to the rails during sliding motion. Lugs 54 and 56 are positioned in spaced relation away from tabs 50 and 52 to provide stability to the slide. Lug 56 also engages a stop surface 58 that projects from the rail 20. Engagement between lug 56 and stop surface 58 limits motion of the slide 48 in a direction away from the breech chamber, i.e., out of battery. The presence of stop surface 58 requires that each of the rails 18 and 20 have a gap 60 to permit the lugs 54 and 56 to be positioned beneath the rails upon mounting of the slide 48 onto the rails. Mounting of the slide 48 is effected by orienting the slide angularly with respect to the rails, positioning the tabs 50 and 52 beneath the rails from their ends, aligning the lugs 54 and 56 with their respective gaps 60, and pivoting the slide toward the rails so that the lugs pass through the gaps and position themselves between the rails and the frame 16.

Figure 6:
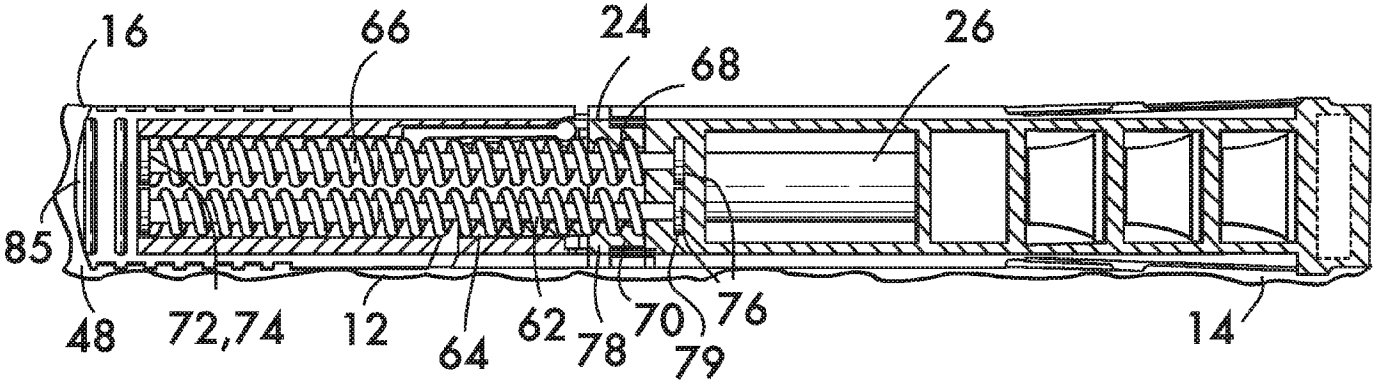
FIG. 6 is an isometric partial sectional view of the suppressed pistol shown in FIG. 1.
Figure 7:
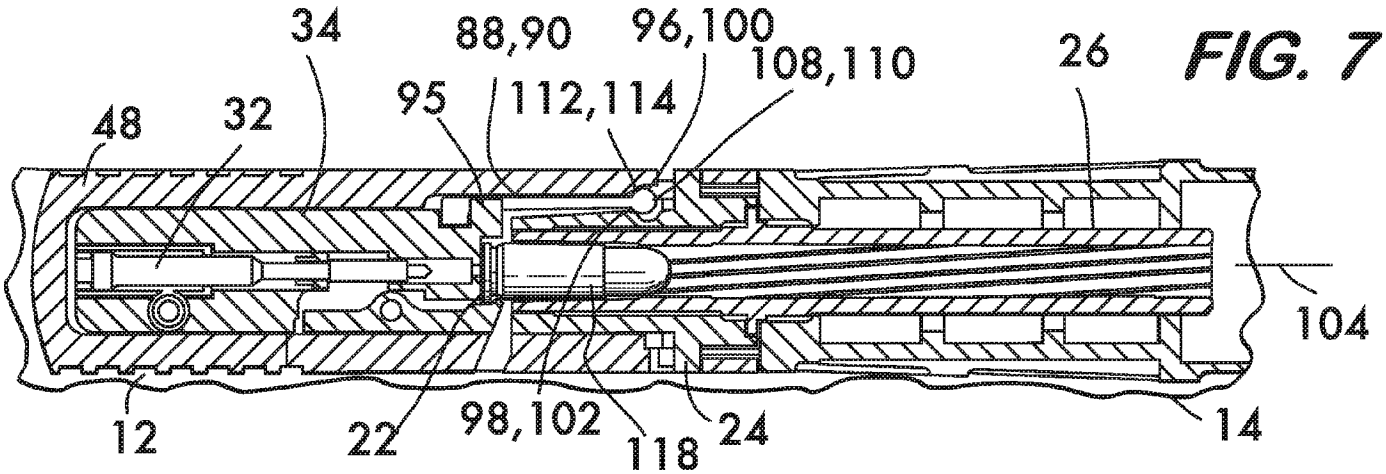
FIGS. 7, 7A, 8 and 9 are partial sectional views illustrating operation of the pistol shown in FIG. 1.
Figure 7A:
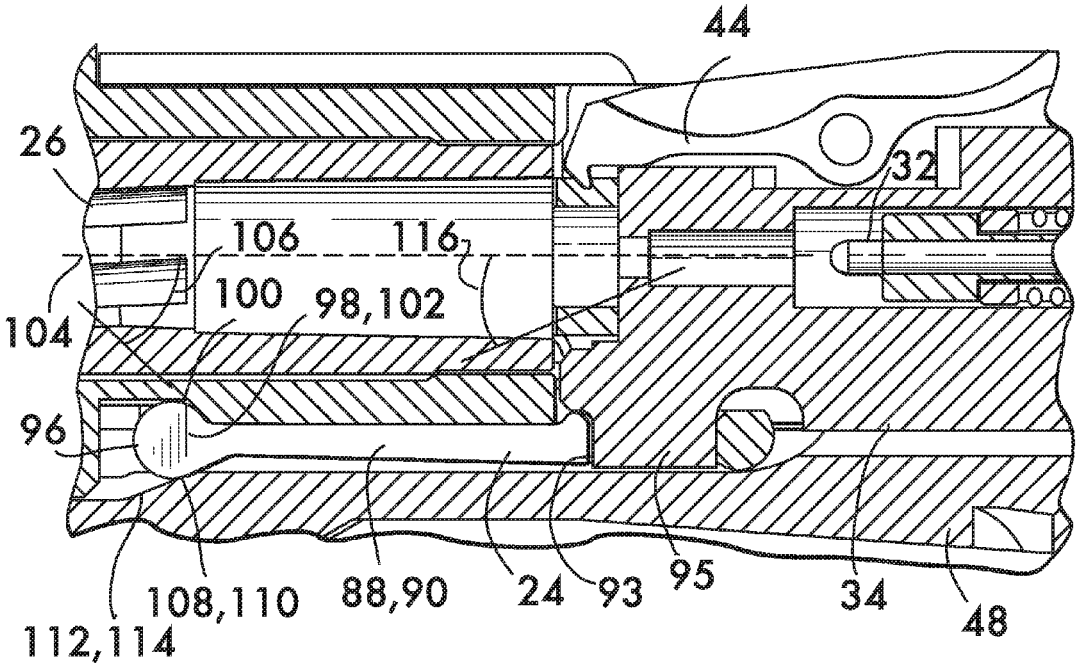

As shown in FIG. 7, the breech block 34 is positioned within the slide 48. As described below, engagement between the slide 48 and the breech block 34 biases the breech block toward the breech 22 and into battery. As shown in FIG. 6, the slide 48 itself is biased toward the breech 22 by one or more return springs 62 (in this example two return springs). Return springs 62 are positioned within a cavity 64 positioned within the slide 48 above the breech block 34 and operate in conjunction with respective guide rods 66. The guide rods 66 have a first end 68 attached to the head piece 24 and are thus immobile relative to frame 16. Return springs 62 act between a front wall 70 defining the cavity 64 in the slide 48 and a stop surface 72 projecting from a second end 74 of the guide rods 66, the second end 74 residing within the cavity 64 of the slide 48. Motion of the slide 48 away from the breech 22 compresses the springs 62 between the front wall 70 and the stop surfaces 72, and the springs 62 bias the slide 48 toward the breech 22 after the energy of a discharged round is dissipated. Engagement between the slide 48 and the breech block 34 (see FIG. 7) returns the breech block to battery.

It is advantageous to removably attach the guide rods 66 to the head piece 24 to permit assembly and disassembly of the pistol 12. As shown by way of example in FIGS. 2 and 6, attachment of the guide rods 66 to the head piece 24 is via enlarged heads 76 at ends 68 of each guide rod 66. As shown in FIGS. 2 and 2A, ends 68 of guide rods 66 engage a clip 78 which is pivotably mounted on head 24 via a pivot pin 80. Pivoting of the clip 78 is controlled by a spring and plunger detent 82 which engages concave surfaces 84 adjacent to the pivot pin 80 and holds the clip in an open or closed position (shown). Clip 78 has cutouts 79 which receive ends 68 of guide rods 66. As shown in FIG. 2A, each cutout 78 has two counter-bored surfaces, an axially facing surface 81 and a radially facing surface 83. When the clip 78 is in the closed position and engaging the ends 68 of the guide rods (not shown for clarity) the enlarged heads 76 of the guide rods 66 are biased into engagement with the axial surfaces 81 under the force of the return springs 62. This fixes the guide rods 66 to the head piece 24. Radial surfaces 83 also engage the enlarged heads 76 which prevents pivoting motion of the clip 78 from the closed to the open position. To pivot clip 78 into the open position it is necessary to push the guide rods 66 toward the head piece 24. This compresses the return springs 62 and disengages the enlarged heads 76 from the radial surface 83, which can then be pivoted to the open position to release the guide rods 66 from the head piece 24 and permit the slide 48 to be removed. Motion of the guide rods 66 is effected by a button 85 in the end of slide 48 (see FIGS. 2 and 6).

As shown in FIGS. 2, 2B, 7 and 7A, a link 88 extends between the breech block 34 and the frame 16 via engagement with the head piece 24. In this example link 88 comprises a plate 90 captured between the breech block 34 and the slide 48. One end 92 of the link 88 has an opening 93 which receives a boss 95 projecting from the breech block 34. Interaction between the boss 95 and opening 93 secures the link 88 to the breech block 34. The opposite end 94 of link 88 has a first cam follower 96 that engages a first cam 98 on the frame 16. In this example, the first cam follower comprises a cylindrical surface 100 mounted on the end 94 of plate 90. The first cam 98 is part of the head piece 24 and comprises a first surface 102 oriented angularly with respect to a firing axis 104 defined by the barrel 26. The first surface 102 may have an orientation angle 106 from about 20° to about 70°. An orientation angle of about 45° is thought advantageous for the first surface 102. A second cam 108 is mounted on the link 88. In this example the second cam 108 comprises a cylindrical surface 110 mounted on end 94 of the plate 90. The second cam 108 engages a second cam follower 112 mounted on the slide 48. Second cam follower 112 comprises a second surface 114 oriented angularly with respect to the firing axis 104. The second surface 114 may have an orientation angle 116 from about 5° to about 60°. An orientation angle of about 30° is thought advantageous for the second surface.

The length of the link 88 and the orientation angles 106 and 116 of the first and second surfaces 102 and 114 determine the relative motion between the slide 48 and the breech block 34.

Figure 8:
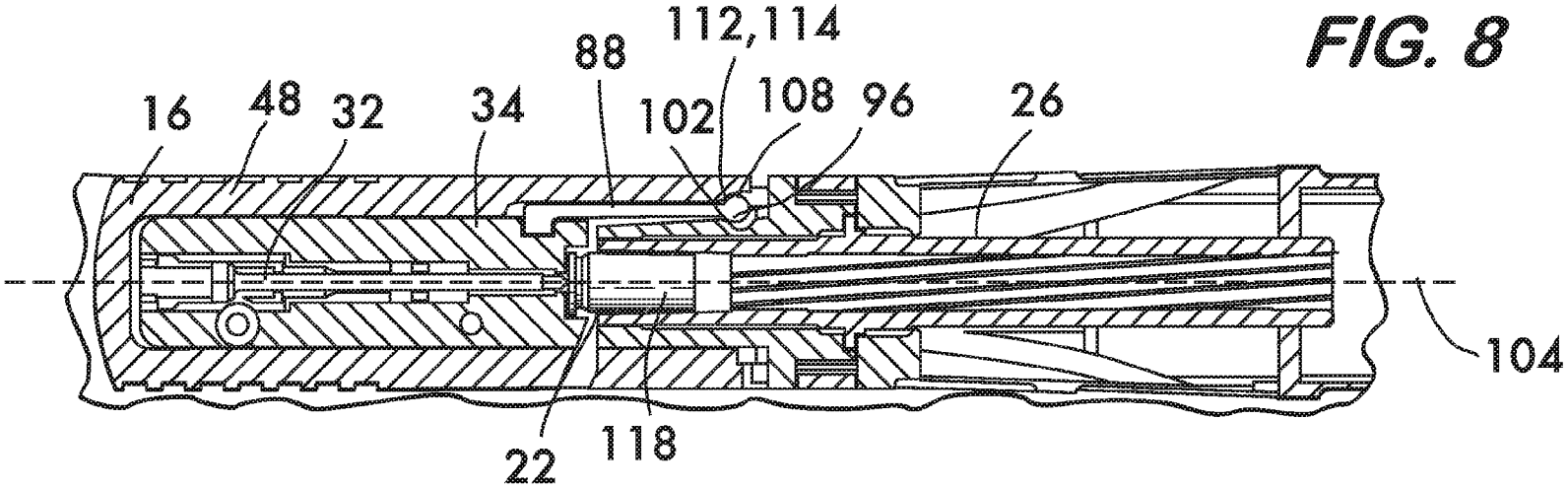
Figure 9:
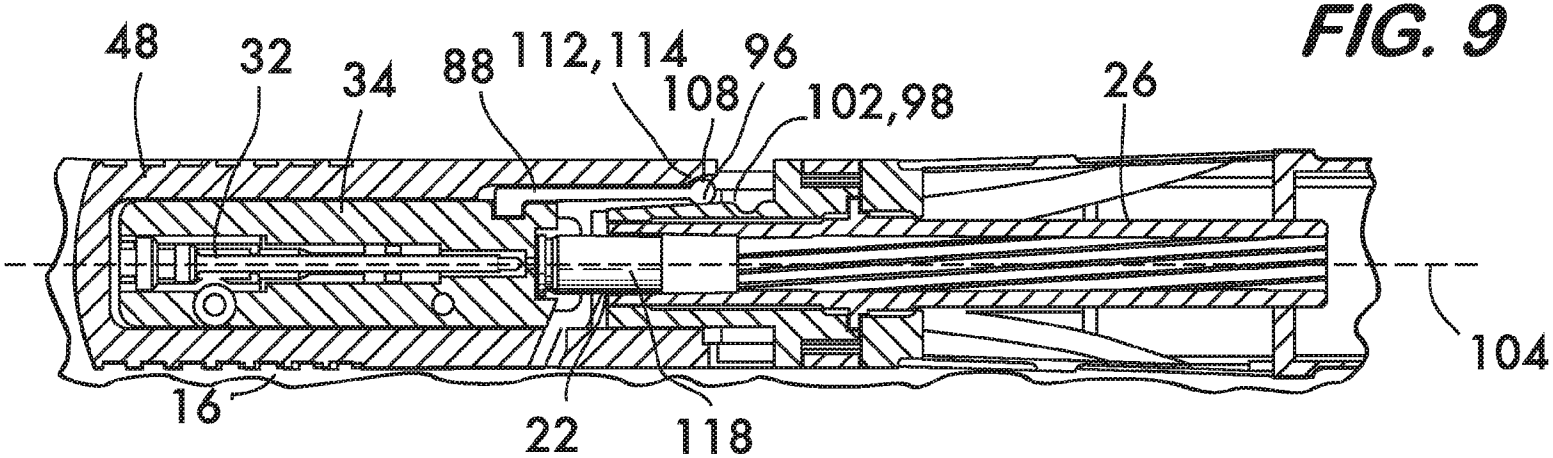

Operation of the pistol 12 is described with reference to FIGS. 7-9. Pistol 12 operates under the blow back system of semi-automatic operation. Accordingly, the barrel 26 is fixed to the frame 16 and neither the breech block 34 nor the slide 48 is locked to the barrel. As shown in FIG. 7 the pistol is ready to fire with a cartridge 118 in the chamber of breech 22 and the breech block 34 in battery. A pull of the trigger (not shown) causes the striker 32 to hit the cartridge primer; the cartridge discharges and the projectile moves down the barrel 26. Conservation of momentum requires that the breech block 34, engaged with the cartridge, move away from the breech 22.

As the breech block 34 moves out of battery away from breech 22 it also pushes on the slide 48, which also moves away from the breech, compressing the return springs 62 (see also FIG. 6). Motion of the breech block 34 also draws the link 88 in a direction away from breech 22, causing the first cam follower 96 to move up the first surface 102, thereby pivoting the link 88 outwardly toward the slide 48. Pivoting motion of the link causes the second cam 108 to engage the second surface 114 of the second cam follower 112 on the slide 48. Camming action between the second cam 108 and second cam follower 112 forces a separation between the slide 48 and the breech block 34 as shown in FIG. 8. As shown in FIG. 9 the separation is maintained by contact between the second cam 108 and second cam follower 112 as both the breech block 34 and the slide 48 continue moving away from the breech to extract and eject the spent cartridge 118. Once the momentum of recoil is spent, the return springs 62 bias the slide 48 back toward the breech 22 and into battery along with the breech block, stripping and chambering the next cartridge in completion of the blow back cycle. The first cam follower 96 rides down the surface 102 of the first cam 98 and the surface 114 of the second cam follower 112 rides up the second cam 108, and the separation between the breech block 34 and the slide 48 closes, completing the cycle as shown in FIG. 7.

Figure 10:
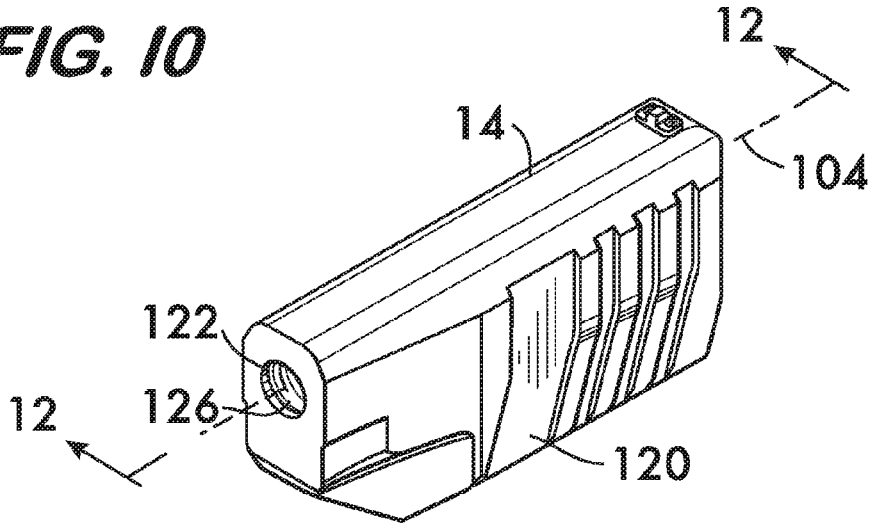
FIGS. 10 and 11 are isometric views of an example suppressor.
Figure 11:
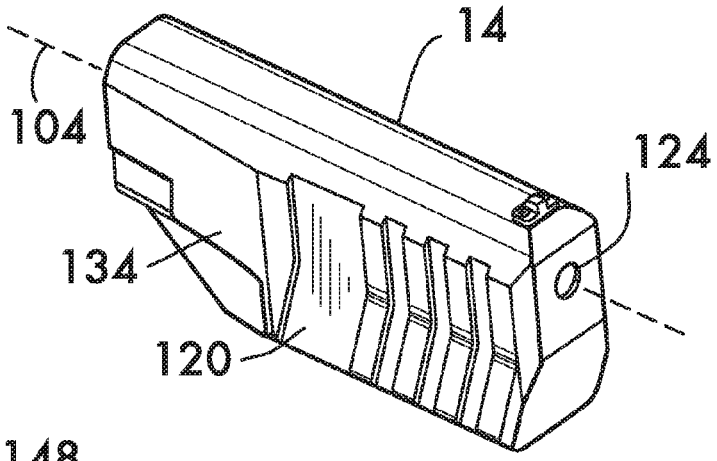

For the example suppressed pistol 10 of FIG. 1, the associated suppressor 14 is shown in detail in FIGS. 10 and 11 and comprises a container 120 having an entrance orifice 122 and an exit orifice 124 aligned with one another along the firing axis 104. Means for attaching the suppressor 14 to the pistol 12 are positioned within the entrance orifice 122. In this example the attachment means comprises internal threads 126 that engage external threads 128 on the barrel 26. As indicated by the location of the threads 128 on the barrel 26 (see FIG. 2), container 120 is attached to barrel 26 between the muzzle 130 and the breech 22. Other attachment means are also feasible, for example, as disclosed in U.S. Pat. Nos. 8,162,100; 8,439,155; 8,950,546 and 8,714,301 and hereby incorporated by reference.

Figure 12:
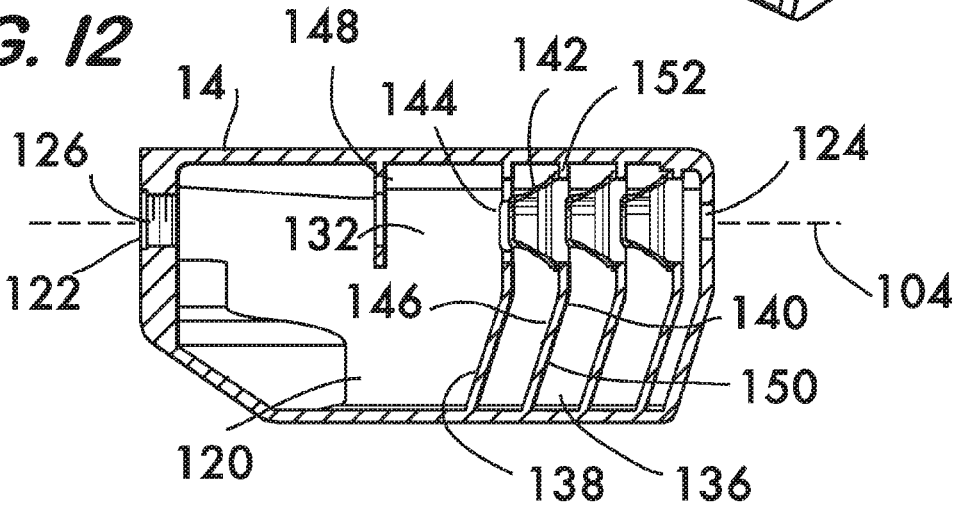
FIG. 12 is a longitudinal sectional view of the suppressor shown in FIG. 10 taken at line 12-12.

As shown in FIGS. 11 and 12, the container comprises first and second oppositely disposed sidewalls 132 and 134 between which are a plurality of baffle chambers 136. As shown in FIG. 12, baffle chambers 136 include baffles 138. Three baffles are shown by way of example. At least one of the baffles 138 comprises a plate 140 oriented transversely to the firing axis 104 and the sidewalls 132 and 134. A truncated cone 142 projects from the plate 140 toward the entrance orifice 122. Cone 142 defines an opening 144 through the plate 140. The opening 144 is aligned with firing axis 104 and is also offset from the geometric center 146 of the plate 140. An expansion chamber 148 is also defined by the container 120, the expansion chamber being positioned between the entrance orifice 122 and the baffle chambers 136. When suppressor 14 is mounted on pistol 12 the barrel 26 extends into the expansion chamber 148.

Figure 13:
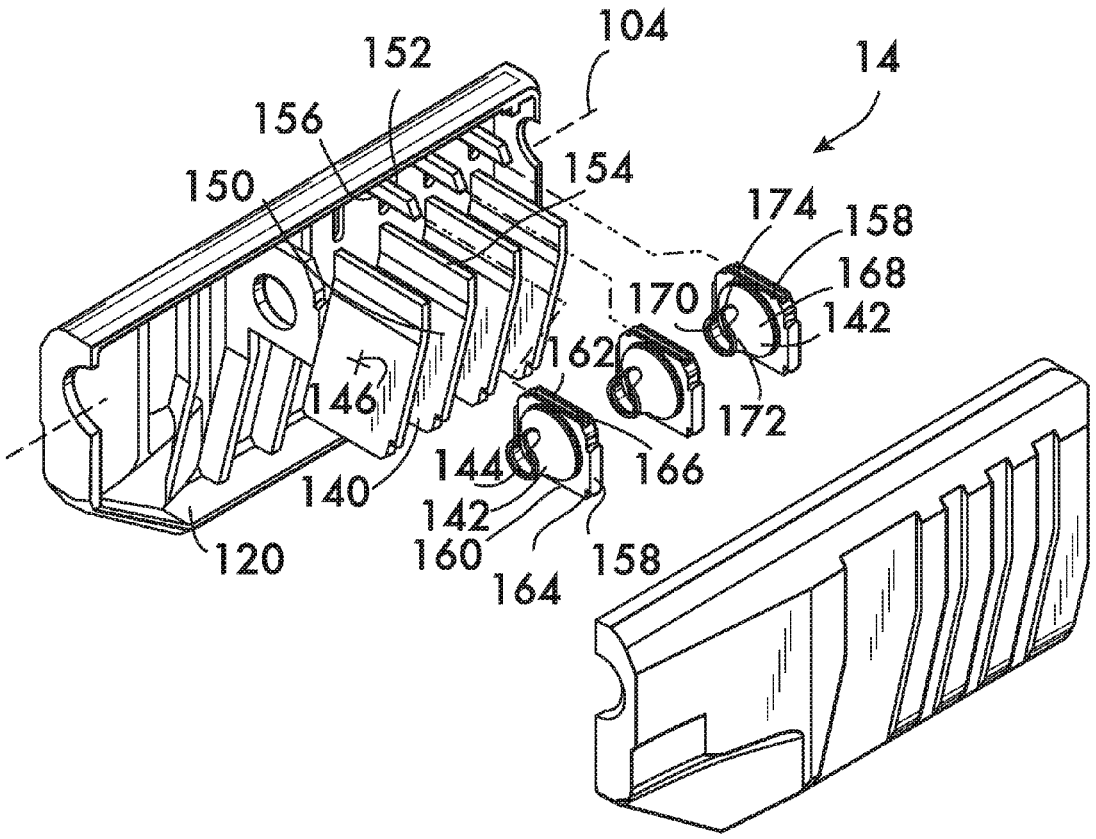
FIG. 13 is an exploded isometric view of the suppressor shown in FIG. 10.

FIG. 13 shows an exploded view of an example suppressor 14 wherein the plates 140 comprise first and second webs 150 and 152. The first and second webs are aligned with one another and are oriented transversely to the firing axis 104. First web 150 has a first edge 154 and the second web 152 has a second edge 156 aligned, and in facing relation with the first edge. The truncated cone 142 is positioned between the first and second edges 154 and 156 of the first and second webs 150 and 152. To permit mounting of cones 142 as a separate piece, the cones comprise a surrounding frame 158. Frame 158 comprises first and second legs 160 and 162. A first channel 164 is positioned within the first leg 160 and a second channel 166 is positioned in the second leg 162. The channels 164 and 166 extend lengthwise along their respective legs 160 and 162 and respectively receive the first and second edges 154 and 156 of the webs 150 and 152. This construction, wherein the cones 142 are separate piece parts, permits the material forming the suppressor 14 to be tailored as needed to achieve performance goals. For example, the container 120 including webs 150 and 152 may be made of lightweight metal such as aluminum or titanium whereas the cones 142 may be constructed from heat resistant steel. This construction provides a lightweight structure which can nevertheless withstand the high temperatures of the propellant gases which impinge directly on the lead cone. As suggested in FIG. 13, the sidewalls 132 and 134 comprising the container 120 are formed, by machining, casting, 3D printing, metal injection molding or other appropriate techniques, the cones punched or die formed and then assembled into the webs, whereupon the sidewalls are butt welded together. In the example embodiment shown in FIGS. 12 and 13 the first web 150 is significantly longer than the second web 152. This asymmetry positions the openings 144 of the cones 142 offset from the geometric center 146 of the plates 140. The example also has four sets of webs 150 and 152, but only three cones 142. Tests have shown that this configuration provides improved noise suppression over four cone designs.

As shown in detail in FIG. 13, cones 142 are right circular cones in this example and have a sidewall 168 with an inner surface 170 surrounding the firing axis 104. A lip 172 is positioned on the inner surface 170. Lip 170 extends around the cone and projects toward the firing axis 104. In this example the lip 172 is positioned at the end of cone 142 distal to the frame 158. It is believed that lip 172 induces turbulence into the gas stream passing through the cones 142 and thereby increases the energy dissipation of the stream and adds to the noise reduction of discharge. An aperture 174 extends through the cone sidewall 168. In this example the aperture 174 is contiguous with the opening 144 defined by the cone 142. It is believed that aperture 174 creates a gas jet that is transverse to the gas stream passing through the cones 142. The gas jet is thought to further disrupt the gas flow and dissipate energy to further lessen the noise of discharge.

Figure 14:
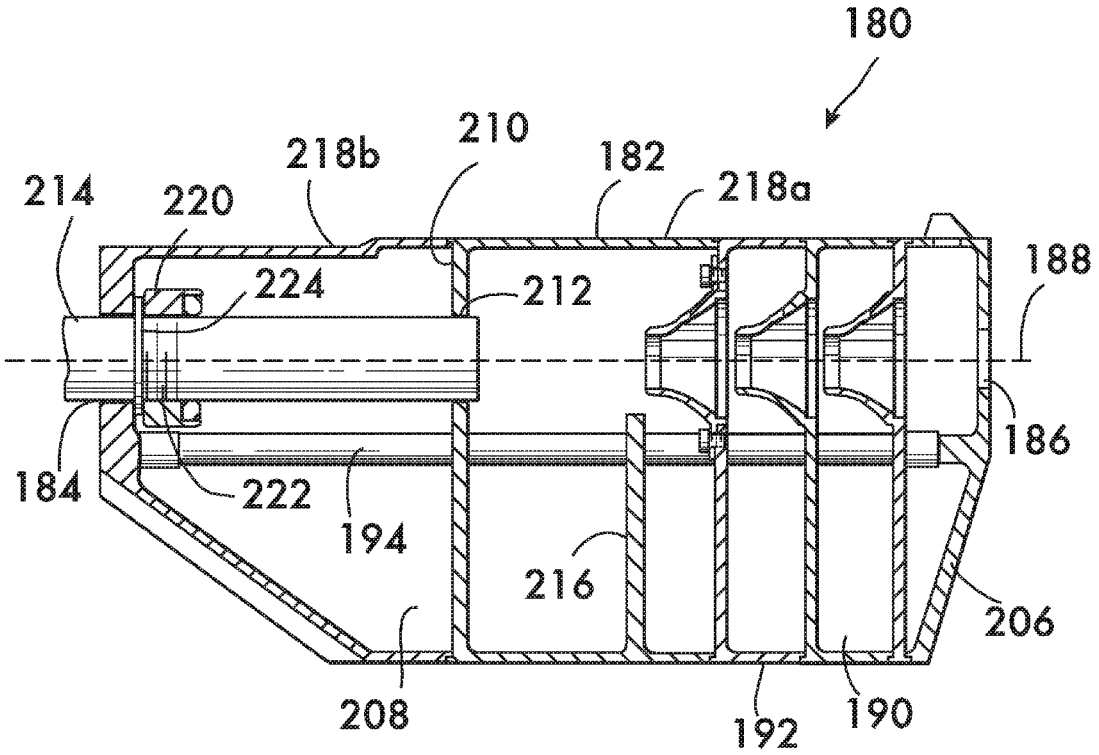
FIG. 14 is a longitudinal sectional view of another example embodiment of a suppressor according to the invention.
Figure 15:
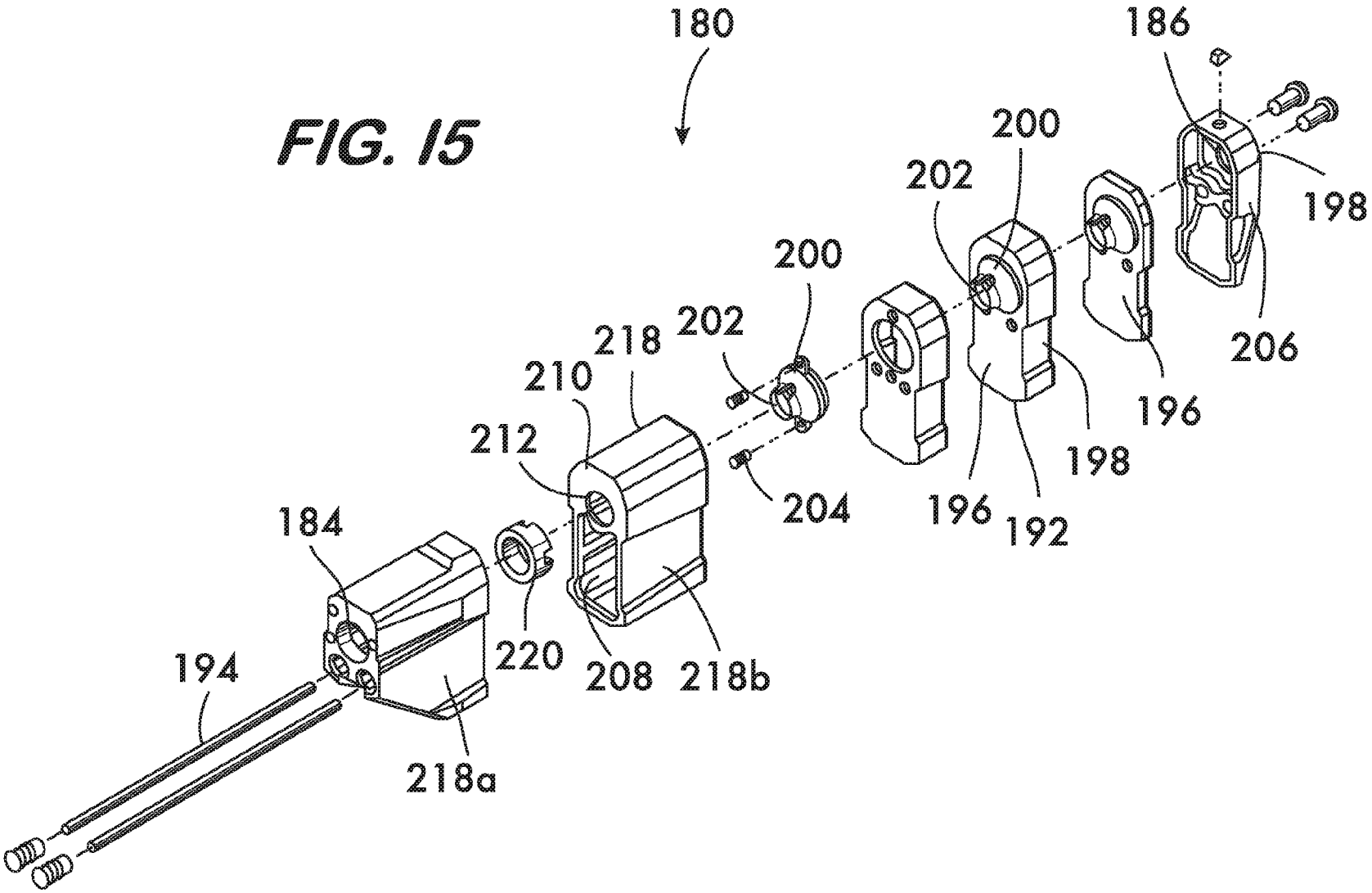
FIG. 15 is an exploded isometric view of the suppressor shown in FIG. 14.

FIG. 14 illustrates another example embodiment of a suppressor 180 according to the invention. Suppressor 180 comprises a container 182 having an entrance orifice 184 and an exit orifice 186. Orifices 184 and 186 are aligned with one another along a firing axis 188 along which a projectile will travel. Container 182 comprises a plurality of baffle chambers 190, in this example three chambers. As shown in FIG. 15, each baffle chamber in this example embodiment comprises a segment 192. Segments 192 are attached to one another end to end to form the container 182. Attachment of the segments is advantageously accomplished using fasteners 194 to permit the number of baffle chambers to be varied by adding or removing segments. More segments 192 increase the degree of noise suppression, fewer segments increase the concealability of the firearm to which the suppressor 180 is attached.

As shown in FIGS. 14 and 15 each segment 192 comprises a plate 196 which is oriented transversely to the firing axis 188. A skirt 198 surrounds the plate 196 and extends transversely to it. Skirt 198 may be integrally formed with plate 196 or a separate part. A truncated cone 200, as described in detail above, projects from the plate 196 and defines an opening 202 through the plate. Cones 200 may be integrally formed with plates 196 or may comprise separate components which are attached by fasteners 204. An end cap 206 defines the exit orifice 186 and is joined to a last segment 192. The entrance orifice 184 is defined by an expansion chamber 208 in this example embodiment. Expansion chamber 208 is attached to a segment 192 opposite from the end cap 206 and comprises a first bulkhead 210 oriented transversely to the firing axis 188. Bulkhead 210 intersects the firing axis 188 and has a through hole 212 which receives and supports the firearm barrel 214. A second bulkhead 216 is positioned in spaced relation to the first bulkhead 210 and is also oriented transversely to the firing axis 188. Second bulkhead 216 is offset from the firing axis. A sidewall 218 surrounds the bulkheads 210 and 216 and extends between them to form the expansion chamber. In this example the sidewall 218 is formed of two parts, 218*a* and 218*b*, with the entrance orifice 184 being in part 218*a*. Thus formed, expansion chamber 208 is expected to provide significant energy dissipation, and consequent noise reduction, by providing an enclosed volume into which the propellant gases initially expand. Suppressor 180 may be attached to the barrel 214 using a threaded nut 220 which engages threads 222 on the barrel and captures a barrel flange 224 between itself and a portion of the expansion chamber sidewall 218. Other attachment means, as described above, are also feasible.

Suppressed pistols according to the invention are expected to combine the advantages of sound suppression with greater ease of holster carry and deployment therefrom.

What is claimed is:

1. A firearm, comprising:

a frame having a first cam mounted thereon;

a barrel fixedly attached to said frame, said barrel having a muzzle and a breech and defining a firing axis therebetween;

a breech block movably mounted on said frame and having a breech face in facing relation with said breech;

a link extending between said breech block and said frame;

a first cam follower mounted on said link, said first cam follower engaging said first cam;

a second cam mounted on said link;

a slide mounted on said frame and movable relatively to both said frame and said breech block, at least a first spring operating between said slide and said frame to bias said slide toward said breech, said slide being engageable with said breech block for biasing said breech block toward said breech;

a second cam follower mounted on said slide and engaged by said second cam; wherein upon motion of said breech block away from said breech, engagement between said first cam follower and said first cam moving said second cam into engagement with said second cam follower thereby moving said breech block relatively to said slide.

2. The firearm according to claim 1, wherein said first cam comprises a first surface oriented angularly with respect to said firing axis.

3. The firearm according to claim 2, wherein said first surface has an orientation angle from 20° to 70°.

4. The firearm according to claim 2, wherein said first surface has an orientation angle of 45°.

5. The firearm according to claim 1, wherein said link comprises a plate and said first cam follower comprises a cylindrical surface mounted on said plate.

6. The firearm according to claim 5, wherein said plate is captured between said breech block and said slide.

7. The firearm according to claim 6, wherein said plate is pivotably attached to said breech block.

8. The firearm according to claim 1, wherein said second cam follower comprises a second surface oriented angularly with respect to said firing axis.

9. The firearm according to claim 8, wherein said second surface has an orientation angle from 5° to 60°.

10. The firearm according to claim 8, wherein said second surface has an orientation angle of 30°.

11. The firearm according to claim 1, wherein said link comprises a plate and said second cam comprises a cylindrical surface mounted on said plate.

12. The firearm according to claim 11, wherein said plate is captured between said breech block and said slide.

13. The firearm according to claim 12, wherein said plate is pivotably attached to said breech block.

14. The firearm according to claim 1, further comprising a striker mounted within said breech block.

15. The firearm according to claim 1, further comprising:

a cavity positioned within said slide, said cavity having a front wall positioned proximate to said breech;

a headpiece surrounding said breech;

a first guide rod having a first end fixed to said headpiece and a second end having a stop surface projecting therefrom, said second end extending into said cavity;

said first spring positioned within said cavity surrounding said first guide rod and engaging said front wall and said stop surface for biasing said slide toward said breech.

16. The firearm according to claim 15, further comprising:

a second guide rod having a first end fixed to said headpiece and a second end having a stop surface projecting therefrom, said second end extending into said cavity;

a second spring positioned within said cavity surrounding said second guide rod and engaging said front wall and said stop surface on said second guide rod for biasing said slide toward said breech.

17. The firearm according to claim 15, wherein said cavity is positioned overlying said breech block.

18. The firearm according to claim 15, further comprising:

a clip movably mounted on said head piece, said clip being movable between an open position and a closed position;

a first cutout positioned in said clip for receiving said first guide rod when said clip is in said closed position, said first cutout comprising an axially facing surface engageable with an enlarged head at an end of said first guide rod for securing said first guide rod to said head piece when said clip is in said closed position.

19. The firearm according to claim 18, wherein said first cutout further comprises a radially facing surface positioned adjacent to said axially facing surface, said radially facing surface engaging said enlarged head and preventing movement of said clip from said closed to said open position.

20. The firearm according to claim 18, wherein said clip is pivotably mounted to said head piece.

21. The firearm according to claim 18, wherein said clip comprises a second cutout positioned adjacent to said first cutout, said second cutout comprising:

an axially facing surface engageable with an enlarged head at an end of a second guide rod for securing said second guide rod to said head piece when said clip is in said closed position;

a radially facing surface positioned adjacent to said axially facing surface of said second cutout, said radially facing surface of said second cutout engaging said enlarged head of said second guide rod and preventing movement of said clip from said closed to said open position.

22. The firearm according to claim 1, further comprising:

first and second rails positioned on opposite sides of said frame and oriented parallel to said firing axis;

at least a first stop surface projecting from said first rail;

first and second tabs positioned on opposite sides of said slide, said first and second tabs respectively engaging said first and second rails for retaining said slide to said frame;

first and second lugs positioned on opposite sides of said slide in spaced relation to said first and second tabs respectively, said first lug being engageable with said first stop surface for limiting motion of said slide in a direction away from said breech.

23. The firearm according to claim 22, wherein each of said rails has a gap therein for receiving a respective one of said first and second lugs to permit assembly and disassembly of said slide onto said frame.

24. The firearm according to claim 1, further comprising a sound suppressor mounted on said barrel.

25. The firearm according to claim 24, wherein said sound suppressor comprises:

a container having an entrance orifice and an exit orifice aligned with said firing axis, said container defining a plurality of baffle chambers.

26. The firearm according to claim 25, wherein said container comprises at least three said baffle chambers.

27. The firearm according to claim 25, wherein said container defines an expansion chamber adjacent to said entrance orifice, said barrel extending into said expansion chamber.

28. The firearm according to claim 27, wherein said container is attached to said barrel between said muzzle and said breech.

29. The firearm according to claim 25, wherein at least one of said baffle chambers includes a baffle comprising:

a plate oriented transversely to said firing axis;

a truncated cone projecting from said plate, said truncated cone defining an opening through said plate.

30. The firearm according to claim 29, wherein said plate has a geometric center, said opening being positioned offset from said geometric center and aligned with said firing axis.

31. The firearm according to claim 29, wherein:

said plate comprises at least first and second webs positioned within said container, said first and second webs being aligned with one another and oriented transversely to said firing axis, said first web having a first edge, said second web having a second edge in facing relation with said first web, said truncated cone being positioned between said first and second edges of said webs.

32. The firearm according to claim 31, wherein said truncated cone is surrounded by a frame having first and second edges oppositely disposed, a first channel being positioned in said first edge and extending lengthwise there along, a second channel being positioned in said second edge and extending lengthwise there along, said first channel receiving said first edge of said first web, said second channel receiving said second edge of said second web for mounting said truncated cone within said container.

33. The firearm according to claim 31, wherein said first web is longer than said second web.

34. The firearm according to claim 25, wherein said baffle chambers are defined by a plurality of segments attached to one another end to end, each one of said segments comprising:

a plate oriented transversely to said firing axis;

a skirt surrounding said plate and extending transversely thereto;

a truncated cone projecting from said plate, said truncated cone defining an opening through said plate.

35. The firearm according to claim 34, further comprising an expansion chamber attached to one of said segments.

36. The firearm according to claim 35, wherein said expansion chamber comprises:

a first bulkhead oriented transversely to said firing axis;

a second bulkhead in spaced relation to said first bulkhead and oriented transversely to said firing axis;

a sidewall surrounding said first and second bulkheads and extending between them.

37. The firearm according to claim 36, wherein said first bulkhead intersects said firing axis and said second bulk head is offset from said firing axis, said first bulkhead having a hole therethrough.

38. The firearm according to claim 36, wherein said expansion chamber defines said entrance orifice.

39. The firearm according to claim 34, wherein further comprising at least one fastener extending between and fixing said segments end to end.

* * * * *